US010088258B1

(12) United States Patent
Leigh

(10) Patent No.: US 10,088,258 B1
(45) Date of Patent: Oct. 2, 2018

(54) DOUBLE-DRUM MAGAZINE ASSEMBLY

(71) Applicant: Young K Leigh, Chantilly, VA (US)

(72) Inventor: Young K Leigh, Chantilly, VA (US)

(73) Assignee: Young K Leigh, Chantilly, VA (US)

( * ) Notice: Subject to any disclaimer, the term of this patent is extended or adjusted under 35 U.S.C. 154(b) by 0 days.

(21) Appl. No.: 15/812,737

(22) Filed: Nov. 14, 2017

(51) Int. Cl.
*F41A 9/73* (2006.01)
*F41A 9/75* (2006.01)

(52) U.S. Cl.
CPC . *F41A 9/75* (2013.01); *F41A 9/73* (2013.01)

(58) Field of Classification Search
None
See application file for complete search history.

(56) References Cited

U.S. PATENT DOCUMENTS 1,921,871 A * 8/1933 Gaidos ..... F41A 9/73
42/50
2007/0107592 A1* 5/2007 Snow ..... F41A 9/68
89/33.02

FOREIGN PATENT DOCUMENTS

KR 101271650 B1 5/2013
WO WO 2011/056236 * 5/2011

* cited by examiner

*Primary Examiner* — Stephen Johnson
(74) *Attorney, Agent, or Firm* — Dentons US LLP

(57) ABSTRACT

The present invention relates to a double-drum magazine assembly which can minimize change of a magazine at firing by maximizing the capacity of cartridges, as compared to a common bar-type magazine, can prevent a linked dummy cartridge from being caught at firing to carry out smooth supply of the cartridges through movement of a linked dummy cartridge, and prevent user's health from being destroyed due to scattering of graphite powder.

11 Claims, 6 Drawing Sheets

DOUBLE-DRUM MAGAZINE ASSEMBLY

BACKGROUND OF THE INVENTION

Field of the Invention

The present invention relates to a double-drum magazine assembly, and more particularly, to a double-drum magazine assembly capable of minimizing change of a magazine and carrying out smooth supply of cartridges at firing.

Background of the Related Art

Firearms, such as rifles, are generally used by soldiers or police officers as a personal weapon.

Recently, a lot of ordinary persons enjoy carrying out a shooting exercise using cartridges for the purpose of sports or hobby.

Meanwhile, a common cartridge, for example, a cartridge for a rifle, is made in the shape of a small bar so that solders or police officers can easily carry the cartridges. As a result, the cartridge can be loaded with about 20 to 30 cartridges therein.

In case where a common bar-type cartridge is used at firing demanding for dozens to hundreds of cartridges, there is a problem of considerable cumbersome due to change of the cartridges.

In order to solve the above problem, a drum magazine is disclosed in Korean Patent No. 10-1271650 (published on Jun. 11, 2013).

According to the drum magazine, a linked dummy cartridge loaded between an inner peripheral surface of a housing and a circumference of a wheel mounted in the housing in advance is moved by pressing of a pushing member which rotates with the wheel, to push and discharge a cartridge to be loaded later.

In this instance, since the cartridge is loaded between the inner peripheral surface of the housing and the circumference of the wheel mounted in the housing, a lot of cartridge, about 50 cartridges, can be loaded in the magazine, as compared to the bar-type magazine, thereby reducing cumbersome caused by the change of the magazine at firing.

However, the drum magazine according to the related art has a problem in which the linked dummy cartridge is caught.

Specifically, a plurality of dummy cartridges 310*a* of the linked dummy cartridge 300*a* in the drum magazine according to the related art are connected to each other by a linking member 320*c* arranged in a zigzag pattern, as illustrated in FIG. 10. Since the linking member 320*c* is easily moved, the dummy cartridges 310*a* are individually moved, as illustrated in FIG. 11. Therefore, the linked dummy cartridge 300*a*, with the arrangement being distorted, is caught between the inner peripheral surface of the housing and the circumference of the wheel mounted in the housing, thereby hardly carrying out the discharge of the cartridge through the movement of the linked dummy cartridge 300*a*.

Therefore, in the field of manufacturing the conventional drum magazine, graphite power is applied on the inner peripheral surface of the housing, so that the linked dummy cartridge is easily slid on the inner peripheral surface of the housing by the contact with the graphite power, thereby carrying out smooth movement of the linked dummy cartridge.

However, even though the graphite powder is applied on the inner peripheral surface of the housing, it is not possible to prevent the dummy cartridge from being moved, thereby bring about the above problem in that the linked dummy cartridge is stilled caught.

Also, since the graphite powder applied on the inner peripheral surface of the housing is easily scattered by the impact applied at firing, there is a problem of being harmful to user's health by breathing of the graphite powder through a respiratory organ.

Although some double-drum magazine assemblies have been developed to minimize change of the magazine at firing by maximizing the capacity of the cartridges, as compared to the common bar-type magazine, preventing the linked dummy cartridge from being caught at firing to carry out the smooth supply of the cartridges through movement of the linked dummy cartridge, and preventing the user's health from being destroyed due to scattering of the graphite powder, satisfactory results are not obtained up to now.

SUMMARY OF THE INVENTION

Therefore, the present invention has been made in view of the above problems, and one object of the present invention is to provide a double-drum magazine assembly capable of solving considerable cumbersome caused by change of magazine at firing, as compared to a common bar-type magazine.

Another object of the present invention is to provide a double-drum magazine assembly capable of solving a problem of difficulty in discharge of cartridge which is caused by a situation in which a linked dummy cartridge is caught between an inner peripheral surface of a housing and a circumference of a wheel mounted to the housing at firing.

Further another object of the present invention is to provide a double-drum magazine assembly capable of solving a problem of being harmful to user's health by breathing of graphite powder through a respiratory organ at firing.

In order to achieve the above objects, according to one aspect of the present invention, there is provided a double-drum magazine assembly including: a first drum unit and a second drum unit which are arranged in a bilateral symmetric manner; and a straight unit which is interposed between the first drum unit and the second drum unit, wherein a linked dummy cartridge loaded in the first drum unit and the second drum unit in advance pushes a cartridge which is loaded in the first drum unit and the second drum unit later to discharge the cartridge to the straight unit, the linked dummy cartridge includes a plurality of dummy cartridges each having a projectile on one end thereof and the body on the other end, with a linking groove being formed between the projectile and the body, the dummy cartridges are connected to each other by linking a linking member to the linking groove, and the linking member has a first linking member positioned adjacent to the projectile at the linking groove, a second linking member positioned adjacent to the body at the linking groove, and a third linking member positioned between the first linking member and the second linking member at the linking groove.

According to another aspect of the present invention, there is provided a double-drum magazine assembly including: a first drum unit and a second drum unit which are arranged in a bilateral symmetric manner; and a straight unit which is interposed between the first drum unit and the second drum unit, wherein a linked dummy cartridge loaded in the first drum unit and the second drum unit in advance pushes a cartridge which is loaded in the first drum unit and the second drum unit later to discharge the cartridge to the straight unit, the linked dummy cartridge includes a plurality of dummy cartridges each having a projectile on one end thereof and the body on the other end, with a linking groove being formed between the projectile and the body, the dummy cartridges are connected to each other by linking a linking member to the linking groove, and the linking member has a first linking member positioned adjacent to the projectile at the linking groove, a second linking member positioned adjacent to the body at the linking groove, and a third linking member positioned between the first linking member and the second linking member at the linking groove.

With the above configuration, the double-drum magazine assembly according to the present invention includes the first drum unit and the second drum unit, and the cartridges are respectively loaded in the first drum unit and the second drum unit. Therefore, the first drum unit and the second drum unit are respectively loaded with the cartridges more than a common bar-type cartridge, thereby minimizing replacement of the magazine at firing and thus troublesome due to the frequent change of the magazine.

In addition, since the first and second linking members and the third linking member are linked to the dummy cartridge, the first and second linking members are supported by the third linking member, so that the linked state of the dummy cartridges is strong, thereby minimizing the movement of the dummy cartridges and thus preventing the linked dummy cartridge from being twisted due to the movement of the dummy cartridge. As a result, the linked dummy cartridge is prevented from being caught in the first drum unit and the second drum unit, thereby smoothly discharging the cartridge.

Also, since the linked dummy cartridge is prevented from being caught and thus the cartridge is smoothly discharged, it is not necessary to apply the graphite powder on the inside of the housing, thereby preventing the user's health from being destroyed due to the scattering of the graphite powder.

DETAILED DESCRIPTION OF THE PREFERRED EMBODIMENT

Preferred embodiments of the present invention will now be described in detail with reference to the accompanying drawings.

Figure 1:
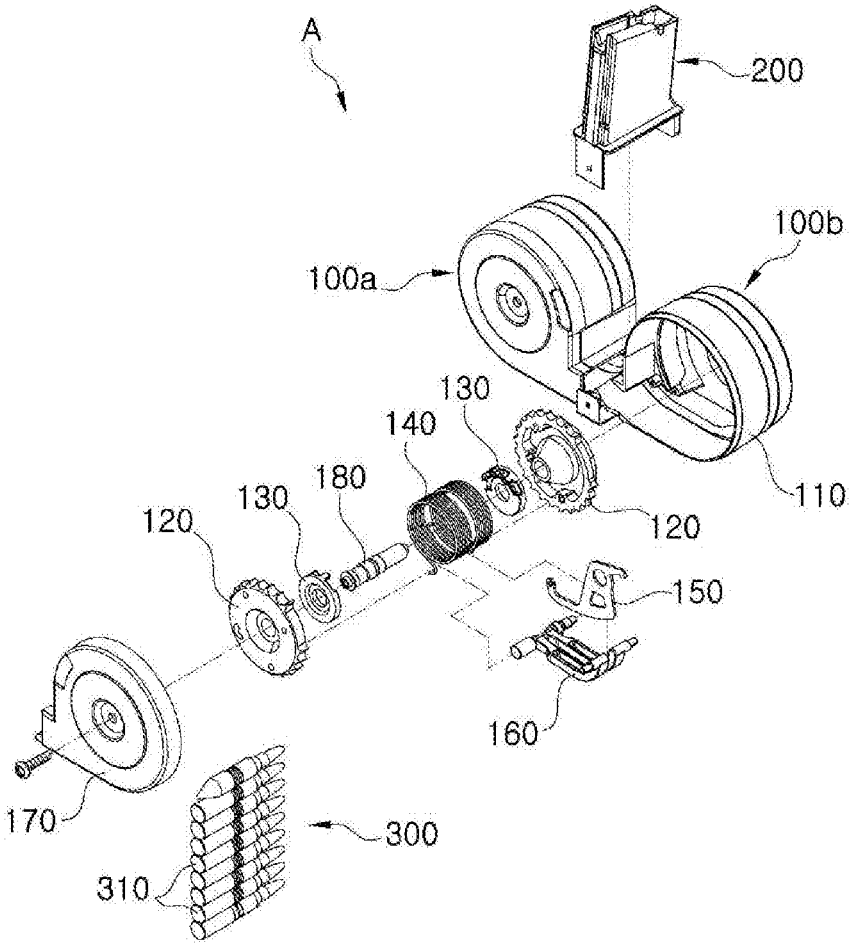
FIG. 1 is an exploded perspective view illustrating a structure of a double-drum magazine assembly according to first and second embodiments of the present invention.
Figure 2:
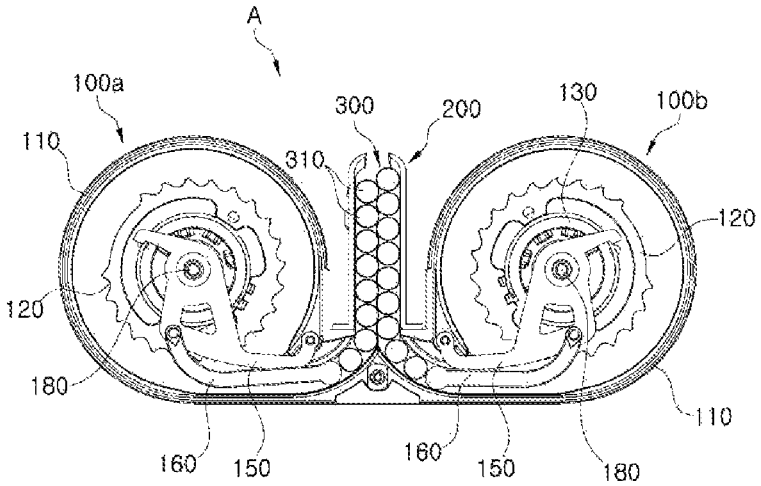
FIG. 2 is a cross-sectional view illustrating the structure of the double-drum magazine assembly according to the first and second embodiments of the present invention.

As illustrated in FIGS. 1 and 2, a drum magazine assembly A according to the first embodiment of the present invention includes a first drum unit 100*a*, a second drum unit 100*b*, a straight unit 200, and a linked dummy cartridge 300.

The first drum unit 100*a* and the second drum unit 100*b* are arranged in a bilateral symmetric manner, with the straight unit 200 being interposed therebetween.

The first drum unit 100*a* and the second drum unit 100*b* communicate with the straight unit 200, so that cartridge 400 fed through the straight unit 200 can be loaded in the first drum unit 100*a* and the second drum unit 100*b*, and also the cartridge 400 discharged from the first drum unit 100*a* and the second drum unit 100*b* can be fed to the straight unit 200.

The first drum unit 100*a* and the second drum unit 100*b* respectively include a cylindrical housing 110, of which a front and a portion of a side are opened, front and rear wheels 120 which are rotatably mounted to an inside of the housing 110, a spacing member 130 for spacing the front and rear wheels 120, a resilient member 140 for resiliently supporting forward and reverse rotation of the front and rear wheels 120, an aligning member 150 for aligning the linked dummy cartridge 300 and cartridge 400 loaded between the housing 110 and the front and rear wheels 120, a pushing member 160 provided between the front and rear wheels 120 to push the linked dummy cartridge 300 loaded between the housing 110 and the front and rear wheels 120, and a cover 170 for closing the opened front of the housing 110.

The linked dummy cartridge 300 loaded between the housing 110 and the front and rear wheels 120 in advance is moved by pressure of the pushing member 160, the cartridge 400 to be loaded between the housing 110 and the front and rear wheels 120 later can be pushed and then fed into the straight unit 200.

Figure 5:
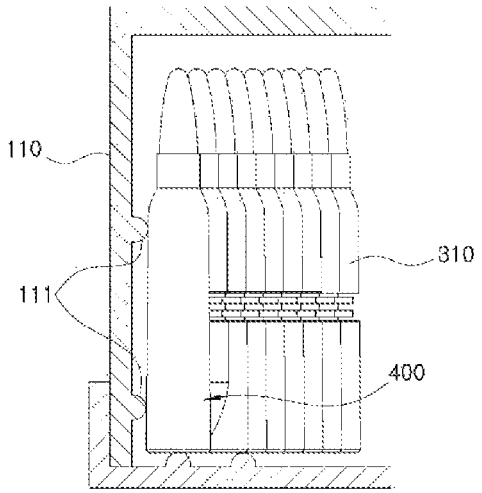
FIG. 5 is a view illustrating a protrusion formed on an inner periphery surface of a housing in the double-drum magazine assembly according to the first and second embodiments of the present invention.

The housing 110 has hemispheric protrusions 111 formed on an inner peripheral surface, as illustrated in FIG. 5.

A frictional resistance is minimized when the dummy cartridge 310 and the cartridge 400 move in the housing 110, as the outer peripheral surfaces of the dummy cartridge 310 and the cartridge 400 are brought into contact with the protrusions 111. Therefore, the dummy cartridge 310 and the cartridge 400 can be smoothly moved in the first drum unit 100*a* and the second drum unit 100*b*.

The inner peripheral surface of the housing 110 is preferably polished, as well as the protrusions 111.

If the inner peripheral surface of the housing 110 is polished, the frictional resistance is further minimized when the outer peripheral surfaces of the dummy cartridge 310 and the cartridge 400 are brought into contact with the inner peripheral surface, so that the dummy cartridge 310 and the cartridge 400 can be further smoothly moved in the first drum unit 100*a* and the second drum unit 100*b*.

Figure 6:
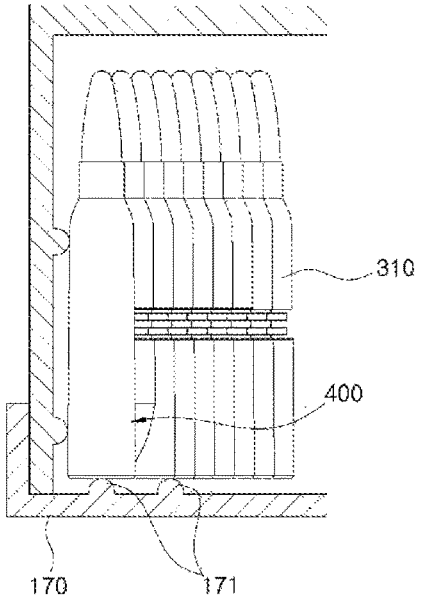
FIG. 6 is a view illustrating a protrusion formed on an inner periphery surface of a cover in the double-drum magazine assembly according to the first and second embodiments of the present invention.

As illustrated in FIG. 6, the cover 170 may be provided with a hemispheric protrusion 171 formed on the inner peripheral surface thereof in a spiral shape.

When the dummy cartridge 310 and the cartridge 400 are spirally loaded in the housing 110, a flat surface 312*a* of a body 312 which will be described later is brought into contact with the protrusion 171. Therefore, as the frictional resistance is minimized when the dummy cartridge 310 and the cartridge 400 are moved in the housing 110, the dummy cartridge 310 and the cartridge 400 can be smoothly moved in the first drum unit 100*a* and the second drum unit 100*b*.

The inner peripheral surface of the cover 170 is preferably polished, as well as the protrusion 171.

If the inner peripheral surface of the housing 170 is polished, the frictional resistance is further minimized when the outer peripheral surfaces of the dummy cartridge 310 and the cartridge 400 are brought into contact with the inner peripheral surface, so that the dummy cartridge 310 and the cartridge 400 can be further smoothly moved in the first drum unit 100*a* and the second drum unit 100*b*.

Figure 8:
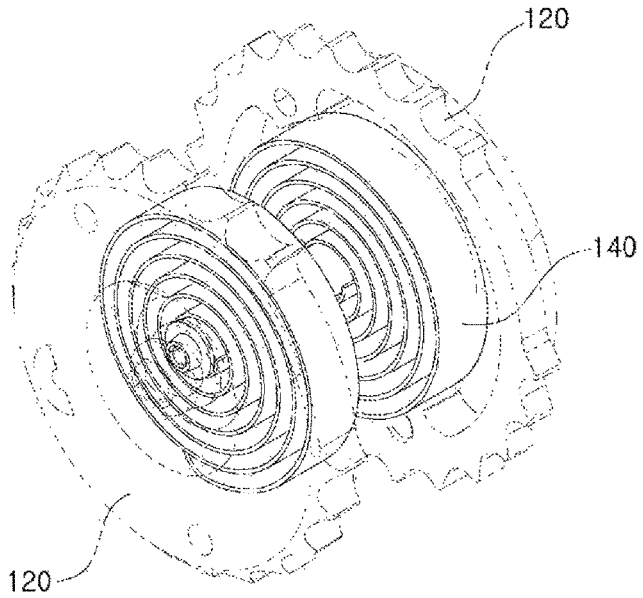
FIG. 8 is a view illustrating another example of a resilient member in the double-drum magazine assembly according to the first and second embodiments of the present invention.
Figure 9:
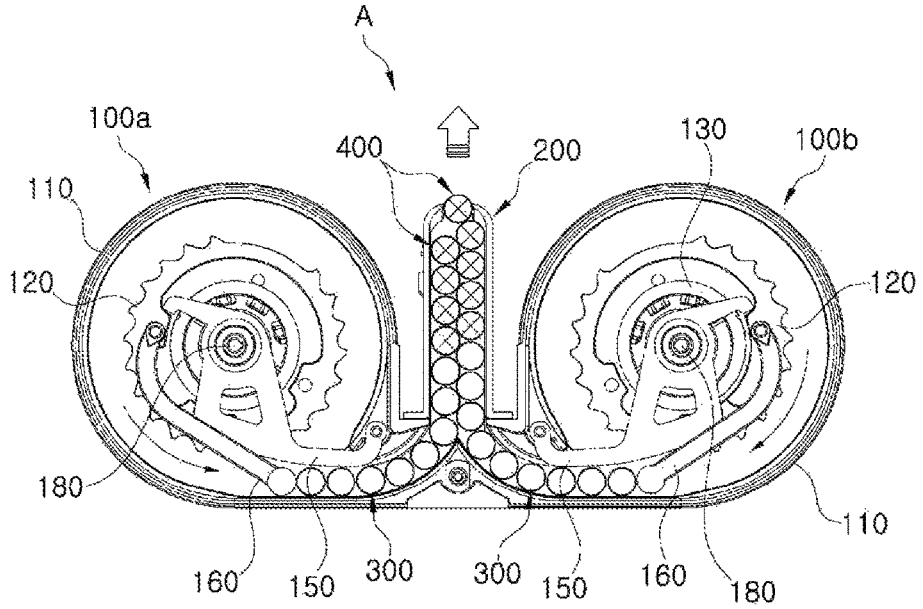
FIG. 9 is a view illustrating the supply of a cartridge in the double-drum magazine assembly according to the first and second embodiments of the present invention.
Figure 10:
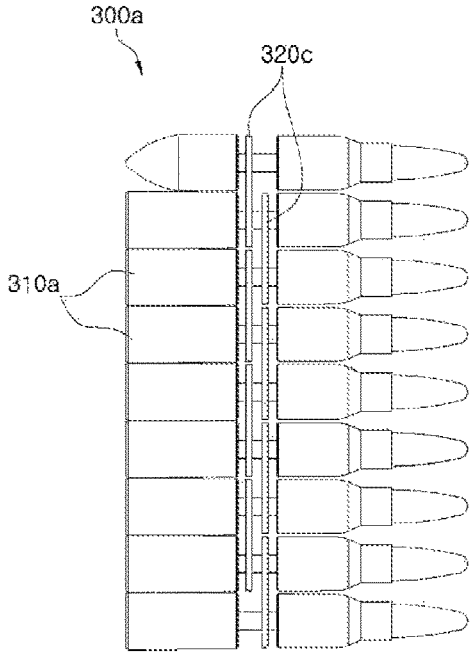
FIG. 10 is a view illustrating an example of linked dummy cartridge in a drum magazine according to the related art.
Figure 11:
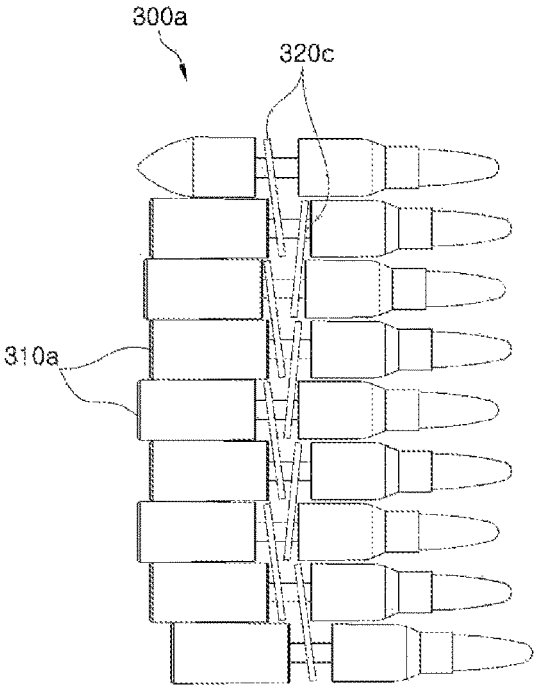
FIG. 11 is a view illustrating movement of dummy rounds in the linked dummy cartridge in the drum magazine according to the related art.

The resilient member 140 is not limited to its shape if it can resiliently support the forward or reverse rotation of the front and rear wheels 120. For example, the resilient member may include a coil spring or a leaf spring, as illustrated in FIG. 8.

A plurality of resilient members 140 of a leaf spring type may be mounted back and forth at regular intervals between the front and rear wheels 120.

The front and rear wheels 120 are formed of a gear type on an outer circumference thereof in the first drum unit 100*a* and the second drum unit 100*b*.

Since the dummy cartridge 310 and the cartridge 400 loaded between the inner peripheral surface of the cover 110 and the front and rear wheels 120 are brought into contact with the gear-shaped outer circumferences of the front and rear wheels 120, the dummy cartridge 310 and the cartridge 400 are smoothly moved by rotation of the front and rear wheels 120.

The aligning member 150 idles around a rotation shaft 180 which penetrates the front and rear wheels 120 in the first drum unit 100*a* and the second drum unit 100*b*, in the state in which a front end of the aligning member 150 is continuously positioned adjacent to the opened side of the housing 110. The dummy cartridge 310 and the cartridge 400 to be loaded through the opened side of the housing 110 are pushed toward the inner peripheral surface of the housing 110 by the contact with the aligning member 150, so that the dummy cartridge 310 and the cartridge 400 are aligned in order.

The straight unit 200 is arranged between the first drum unit 100*a* and the second drum unit 100*b*.

The cartridges 400 to be discharged through the opened sides of the first drum unit 100*a* and the second drum unit 100*b* can be loaded into the straight unit 200.

Figure 7:
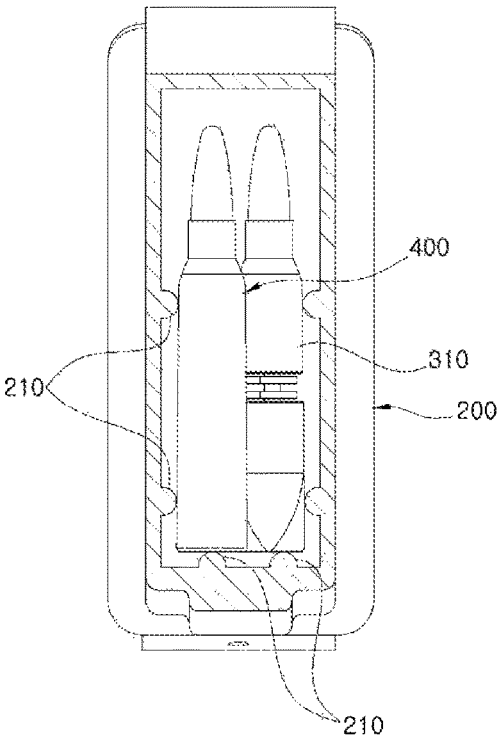
FIG. 7 is a view illustrating a protrusion formed on an inner periphery surface of a straight unit in the double-drum magazine assembly according to the first and second embodiments of the present invention.

In this instance, as illustrated in FIG. 7, the straight unit 200 is provided with hemispheric protrusions 210 formed on inner peripheral surfaces of both side plates and a rear plate thereof.

A frictional resistance is minimized when the dummy cartridge 310 and the cartridge 400 move in the straight unit 200, as the outer peripheral surfaces of the dummy cartridge 310 and the cartridge 400 and the flat surface 312*a* of the body 312 are respectively brought into contact with the protrusions 210. Therefore, the dummy cartridge 310 and the cartridge 400 can be smoothly moved in the straight unit 200.

As an upper end of the straight unit 200 is inserted into a loading unit of a rifle, the cartridge 400 positioned on the uppermost end of the straight unit 200 is loaded in the rifle.

The linked dummy cartridge 300 is moved by the pressing of the pushing member 160 which rotates with the front and rear wheels 120, to push and discharge the cartridge 400 to be loaded in the first drum unit 100*a* and the second drum unit 100*b* later.

The linked dummy cartridge 300 includes a plurality of dummy cartridges 310 each having a projectile 311 on one end thereof and the body 312 on the other end, with a linking groove 313 being formed between the projectile 311 and the body 312.

The dummy cartridges 310 are connected to each other by linking a linking member 320*a* to the linking groove 313.

Figure 3:
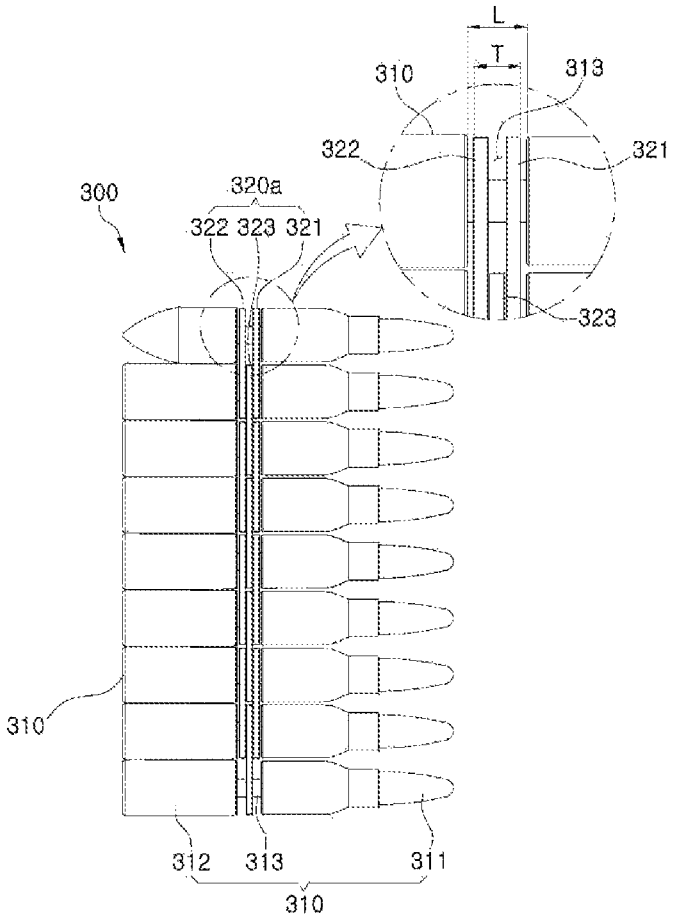
FIG. 3 is a perspective view illustrating a linked state of dummy cartridges of a linked dummy cartridge for use in the double-drum magazine assembly according to the first embodiment of the present invention.

The linking member 320*a* has, as illustrated in FIG. 3, a first linking member 321 positioned adjacent to the projectile 311 at the linking groove 313, a second linking member 322 positioned adjacent to the body 312 at the linking groove 313, and a third linking member 323 positioned between the first linking member 321 and the second linking member 322 at the linking groove 313.

Since the first and second linking members 321 and 322 are supported by the third linking member 323, the linked state of the dummy cartridges 310 is strong, thereby minimizing movement of the dummy cartridges 310 and thus preventing the linked dummy cartridge 300 from being twisted.

The linking groove 313 is preferably formed so that a length L thereof is 0.5 to 2.0 mm longer than the total thickness T of the first linking member 321, the second linking member 322 and the third linking member 323 which are linked to the linking groove 313.

If the length L of the linking groove 313 is 0.5 or less shorter than the total thickness T of the first linking member 321, the second linking member 322 and the third linking member 323 which are linked to the linking groove 313, it is difficult to link the first, second and third linking members 321, 322 and 323. If the length L of the linking groove 313 is 2.0 longer than the total thickness T of the first linking member 321, the second linking member 322 and the third linking member 323 which are linked to the linking groove 313, the dummy cartridges 310 may be moved as the first, second and third linking members 321, 322 and 323 are moved in the linking groove 313. Therefore, the linking groove 313 is preferably formed so that the length T thereof is 0.5 to 2.0 mm longer than the total thickness T of the first linking member 321, the second linking member 322 and the third linking member 323 which are linked to the linking groove 313.

The first, second and third linking members 321, 322 and 323 are preferably formed to have the same configuration.

If the first, second and third linking members 321, 322 and 323 are formed to have the same configuration, it can make the use of the first, second and third linking members 321, 322 and 323.

Any one of the linked dummy cartridges 300 has one more dummy cartridge 310, as compared to other linked dummy cartridge.

Specifically, the linked dummy cartridge 300 loaded in the first drum unit 100*a* has 8 dummy cartridges 310, while the linked dummy cartridge 300 loaded in the second drum unit 100*b* has 9 dummy cartridges 310.

The cartridges 400 supported by the respective linked dummy cartridges 300 are arranged in a zigzag pattern in the straight unit 200, one cartridge positioned on the uppermost end of the straight unit 200 comes into contact with a firing pin of the rifle so as to be fired.

In the linked dummy cartridge 300, the dummy cartridge 310 is preferably made from plastic.

Accordingly, as compared to the case where the dummy cartridge 310 is made from metal, the weight of the linked dummy cartridge 300 is decreased, and the frictional resistance of the dummy cartridge 310 is minimized.

However, the bodies 312 of the dummy cartridges 310 respectively positioned on the uppermost and lowermost ends of the linked dummy cartridge 300 are preferably made of metal.

It is possible to prevent the body 312 from being damaged even when the body 312 of the uppermost dummy cartridge 310 is brought into contact with the firing pin of the rifle, or the body 312 of the lowermost dummy cartridge 310 is brought into contact with the pushing member 160.

Also, in the linked dummy cartridge 300 having one more dummy cartridge 310, the body 312 of the uppermost dummy cartridge 310 is preferably formed to have a conical rear end.

Even though the uppermost dummy cartridge 310 of the linked dummy cartridge 300 is positioned on the uppermost end of the straight unit 200 in the state in which the cartridge is completely out of, the body 312 of the uppermost dummy cartridge 310 is prevented from being brought into contact with the firing pin of the rifle.

A double-drum magazine assembly A according to the second embodiment of the present invention is substantially identical to the double-drum magazine assembly A according to the first embodiment of the present invention, except for a linking member 320*b* of the linked dummy cartridge 300.

Figure 4:
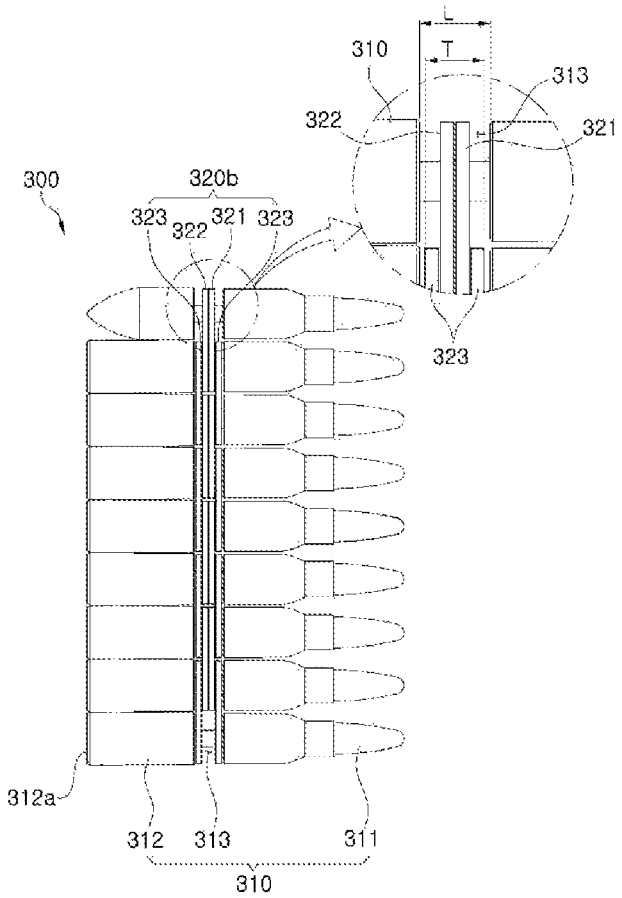
FIG. 4 is a perspective view illustrating a linked state of dummy cartridges in a linked dummy cartridge for use in the double-drum magazine assembly according to the second embodiment of the present invention.

Specifically, the linking member 320*b* in the double-drum magazine assembly A according to the second embodiment of the present invention has, as illustrated in FIG. 4, a first linking member 321 positioned adjacent to the projectile 311 at the linking groove 313, a second linking member 322 positioned adjacent to the body 312 at the linking groove 313, and third linking members 323 respectively positioned at the outside of the first linking member 321 and at the outside of the second linking member 322 at the linking groove 313.

Since the first and second linking members 321 and 322 are supported by the pair of third linking members 323, the linked state of the dummy cartridges 310 is further strong, thereby minimizing movement of the dummy cartridges 310 and thus preventing the linked dummy cartridge 300 from being twisted.

The supply of the cartridges 400 by the double-drum magazine assembly A according to the present invention will now be described in detail.

Before the cartridge 400 is loaded, the linked dummy cartridges 300 loaded in the housings 110 of the first drum unit 110*a* and the second drum unit 110*b* in advance are pushed outwardly by the pressing of the pushing member 160 which rotates with the front and rear wheels 120 mounted in the housing 110, and then are positioned in the straight unit 200.

In this instance, the front and rear wheels 120 are resiliently supported by the forward or reverse rotation of the resilient member 140, and when the cartridge 400 is fed through the opened upper end of the straight unit 200, the front and rear wheels 120 of the first drum unit 100*a* and the second drum unit 100*b* are reversely rotated, so that the linked dummy cartridge 300 is moved to the inside of the housing 110.

By repeating the supply of the cartridges 400 through the opened upper end of the straight unit 200, about 100 cartridges 400 are loaded in the straight unit 200 and between each inner peripheral surface of the first drum unit 100*a* and the second drum unit 100*b* and the outer peripheral surfaces of the front and rear wheels 120.

The linked dummy cartridges 300 loaded in the first drum unit 100*a* and the second drum unit 100*b* in advance are applied by a stretching force of the resilient member 140 which resiliently supports the forward or reverse rotation of the front and rear wheels 120, and the linked dummy cartridge 300 continuously pushes the cartridge 400 toward the straight unit 200. Therefore, even though the cartridge 400 is loaded in the housing 110, the cartridge should be finally positioned in the straight unit 200.

As a result, it is possible to fire with about 100 cartridges 400, without changing the magazine at firing, by mounting the upper end of the straight unit 200 into the rifle.

When the arrangement of the linked dummy cartridge 300 is twisted since the dummy cartridge 310 is moved in the process of gradually feeding the linked dummy cartridge 300 from the inside of the straight unit 200 to the inside of the housing 200, or in the process of gradually feeding the linked dummy cartridge 300 from the inside of the housing 110 to the inside of the straight unit 200, the linked dummy cartridge 300 may be caught by the inside of the housing 110, thereby interrupting the supply of the cartridge 400 by the movement of the linked dummy cartridge 300.

In the dummy cartridge 310 of the linked dummy cartridge 300 according to the present invention, the linking members 320*a* and 320*b* linked with the linking groove 313 have the first, second and third linking members 321, 322 and 323, in which the first linking member 321 and the second linking member 322 which are positioned opposite to the linking groove 313 are supported by the third linking member 323, thereby firmly connecting the dummy cartridges 310 to prevent the dummy cartridges 310 from being moved independently. Therefore, it is possible to prevent the linked dummy cartridge 300 from being twisted due to the individual movement of the dummy cartridges 310.

As a result, since the linked dummy cartridge 300 is not caught by the twist of the linked dummy cartridge 300 in the housing 110, the cartridge 400 can be smoothly supplied by the movement of the linked dummy cartridge 300.

In addition, according to the present invention, the inner peripheral surfaces of the housing 110 and the cover 170 are provided with the hemispheric protrusions 111 and 171. When the dummy cartridge 310 and the cartridge 400 move in the housing 110, the frictional resistance generated by the contact between the dummy cartridge 310 and the cartridge 400 and the inner peripheral surfaces is minimized by the protrusions 111 and 171, thereby smoothly moving the dummy cartridge 310 and the cartridge 400 to further prevent the linked dummy cartridge 300 from being caught in the housing 110.

According to the present invention, also, the linking groove 313 is formed so that the length L thereof is 0.5 to 2.0 mm longer than the total thickness T of the first linking member 321, the second linking member 322 and the third linking member 323 which are linked to the linking groove 313. The movement of the first, second and third linking members 321, 322 and 323 linked to the linking groove 313 is minimized, thereby minimizing the movement of the dummy cartridges 310 due to the movement of the first, second and third linking members 321, 322 and 323, and thus further preventing the linked dummy cartridge 300 from being twisted due to the movement of the dummy cartridge 310. As a result, it is possible to further prevent the linked dummy cartridge 300 from being caught in the housing 110.

The double-drum magazine assembly A according to the present invention can prevent the linked dummy cartridge 300 from being caught, and also can prevent a user's health from being destroyed due to scattering of graphite powder.

Specifically, in case where the inner peripheral surface of the housing 110 is applied by graphite powder so as to prevent the linked dummy cartridge 300 from being caught, the scattering of the graphite powder is harmful to the user's health at firing. The present invention prevents the movement of the dummy cartridge 310 by the first, second and third linking members 321, 322 and 323, and minimizes the frictional resistance by the protrusions 111 and 171 to prevent the linked dummy cartridge 300 from being caught. Accordingly, since it is not necessary to apply the graphite power on the inside of the housing 110, it prevents scattering of the graphite powder at firing, so that the user's health from can be prevented from being destroyed due to the scattering of the graphite powder.

As described above, the double-drum magazine assembly A according to the present invention includes the first drum unit 100*a* and the second drum unit 100*b*, and the cartridges 400 are respectively loaded in the first drum unit 100*a* and the second drum unit 100*b*. Therefore, the double-drum magazine assembly A according to the present invention can be loaded with the cartridges 400 more than a common bar-type cartridge, thereby minimizing replacement of the magazine at firing and thus troublesome due to the frequent change of the magazine. In addition, since the first and second linking members 321 and 322 and the third linking member 323 are linked to the dummy cartridge 310, the first and second linking members 321 and 322 are supported by the third linking member 323, so that the linked state of the dummy cartridges 310 is strong, thereby minimizing the movement of the dummy cartridges 310 and thus preventing the linked dummy cartridge 300 from being twisted due to the movement of the dummy cartridge 310. As a result, the linked dummy cartridge 300 is prevented from being caught in the first drum unit 100*a* and the second drum unit 100*b*, thereby smoothly discharging the cartridge 400. Since the linked dummy cartridge 300 is prevented from being caught and thus the cartridge 400 is smoothly discharged, it is not necessary to apply the graphite powder on the inside of the housing 110, thereby preventing the user's health from being destroyed due to the scattering of the graphite powder.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A double-drum magazine assembly comprising:

a first drum unit and a second drum unit which are arranged in a bilateral symmetric manner; and a straight unit which is interposed between the first drum unit and the second drum unit, wherein linked dummy cartridges respectively loaded in the first drum unit and the second drum unit in advance pushes a cartridge which is loaded in the first drum unit and the second drum unit later to discharge the cartridge to the straight unit, the linked dummy cartridge includes a plurality of dummy cartridges each having a projectile on one end thereof and a body on the other end, with a linking groove being formed between the projectile and the body, the dummy cartridges are connected to each other by linking a linking member to the linking groove, and the linking member has a first linking member positioned adjacent to the projectile at the linking groove, a second linking member positioned adjacent to the body at the linking groove, and a third linking member positioned between the first linking member and the second linking member at the linking groove.

2. A double-drum magazine assembly comprising:

a first drum unit and a second drum unit which are arranged in a bilateral symmetric manner; and a straight unit which is interposed between the first drum unit and the second drum unit, wherein linked dummy cartridges respectively loaded in the first drum unit and the second drum unit in advance pushes a cartridge which is loaded in the first drum unit and the second drum unit later to discharge the cartridge to the straight unit, the linked dummy cartridge includes a plurality of dummy cartridges each having a projectile on one end thereof and a body on the other end, with a linking groove being formed between the projectile and the body, the dummy cartridges are connected to each other by linking a linking member to the linking groove, and the linking member has a first linking member positioned adjacent to the projectile at the linking groove, a second linking member positioned adjacent to the body at the linking groove, and a third linking member positioned between the first linking member and the second linking member at the linking groove.

3. The double-drum magazine assembly according to claim 1, wherein the first drum unit and the second drum unit respectively include a cylindrical housing, of which a front and a portion of a side are opened, front and rear wheels which are rotatably mounted to an inside of the housing, a spacing member for spacing the front and rear wheels, a resilient member for resiliently supporting forward and reverse rotation of the front and rear wheels, an aligning member for aligning the linked dummy cartridge and cartridge loaded between the housing and the front and rear wheels, a pushing member provided between the front and rear wheels to push the linked dummy cartridge loaded between the housing and the front and rear wheels, and a cover for closing the opened front of the housing.

4. The double-drum magazine assembly according to claim 3, wherein the housing has a hemispheric protrusion formed on an inner peripheral surface.

5. The double-drum magazine assembly according to claim 4, wherein the inner peripheral surface of the housing is polished, as well as the protrusion.

6. The double-drum magazine assembly according to claim 3, wherein the cover is provided with a hemispheric protrusion formed on an inner peripheral surface thereof in a spiral shape.

7. The double-drum magazine assembly according to claim 6, wherein the inner peripheral surface of the cover is polished, as well as the protrusion.

8. The double-drum magazine assembly according to claim 3, wherein the resilient member includes a coil spring or a leaf spring.

9. The double-drum magazine assembly according to claim 1, wherein the straight unit is provided with hemispheric protrusions formed on inner peripheral surfaces of both side plates and a rear plate thereof.

10. The double-drum magazine assembly according to claim 1, wherein the linking groove is formed so that a length L thereof is 0.5 to 2.0 mm longer than a total thickness T of the first linking member, the second linking member and the third linking member which are linked to the linking groove.

11. The double-drum magazine assembly according to claim 1, wherein the first, second and third linking members are formed to have identical configuration.

* * * * *